US005862952A

United States Patent [19]

Lee

[11] Patent Number: 5,862,952

[45] Date of Patent: Jan. 26, 1999

[54] WATER DISPENSER OF A REFRIGERATOR

[75] Inventor: Yong-Kweon Lee, Incheon, Rep. of Korea

[73] Assignee: Daewoo Electronics Co., Ltd., Rep. of Korea

[21] Appl. No.: 796,113

[22] Filed: Feb. 6, 1997

[30] Foreign Application Priority Data

May 16, 1996 [KR] Rep. of Korea ..... 1996 16499

[51] Int. Cl.[6] ..... B65B 3/00

[52] U.S. Cl. ..... 222/146.6; 222/505; 222/517; 222/183; 62/338

[58] Field of Search ..... 222/146.6, 183, 222/505, 509, 518, 517; 251/229, 263, 339, 236, 243; 62/338

[56] References Cited

U.S. PATENT DOCUMENTS

| | | | |
|---|---|---|---|
| 999,602 | 8/1911 | Slee | 222/509 |
| 2,239,921 | 4/1941 | Majewski, Jr. | 222/183 |
| 2,274,409 | 2/1942 | Harbison | 222/183 |
| 2,512,395 | 6/1950 | Sundberg | 222/509 |
| 2,761,288 | 9/1956 | Anderson et al. | 62/338 |
| 2,775,877 | 1/1957 | Bruntjen | 222/146.6 |
| 2,777,304 | 1/1957 | Nave | 222/146.6 |
| 2,781,153 | 12/1957 | Roberts | 222/183 |
| 3,107,828 | 10/1963 | Costakos | 222/509 |
| 3,208,641 | 9/1965 | Brugioni | 62/338 |
| 5,142,610 | 8/1992 | Augustine et al. | 222/509 |
| 5,303,849 | 4/1994 | Credle . | |
| 5,526,854 | 6/1996 | Unger | 222/146.6 |

*Primary Examiner*—J. Casimer Jacyna
*Attorney, Agent, or Firm*—Pillsbury Madison & Sutro, LLP

[57] ABSTRACT

A water dispenser of a refrigerator which comprises a reservoir for storing water, and is positioned in a pocket, a holding member for supporting the pocket, a valve assembly for supporting the holding member, and an opening/closing section for operating the valve assembly. The holding member is inserted into the holding member upside down. The valve assembly includes an outlet conduit screw-coupled to the reservoir, through which the water contained in the reservoir is exhausted. The outlet conduit is opened and closed by a packing member, and the packing member is moved upward and downward by the valve rod. The valve rod is moved upward and downward by an opening/closing section having a pair of cams. The water dispenser is simple in structure, increases efficient space use of the refrigerating compartment door, is convenient to use, and can be cleanly maintained.

18 Claims, 6 Drawing Sheets

WATER DISPENSER OF A REFRIGERATOR

BACKGROUND OF THE INVENTION

1. Field of the Invention

The present invention relates to a refrigerator, and more particularly to a valve assembly of a water dispenser.

2. Description of the Prior Art

A water dispenser or beverage dispenser is an implement for automatically dispensing drinking water or beverages, which is installed in a house, an office, or a public lot for domestic or commercial use. Valve assemblies of beverage dispensers which are available for commercial business usually employ actuators, and one of such actuators is disclosed in U.S. Pat. No. 5,303,849 issued to Credle, Jr. on Apr. 19, 1994.

A water dispenser is also utilized in a house or an office. Recently, it has been suggested that various kinds of beverage dispensers be installed in refrigerators. A refrigerator is an appliance for storing a variety of foodstuffs in freezing and/or refrigerating temperatures in order to maintain freshness of the foodstuffs for a long period of time. The refrigerator is generally provided with compartments for storing foodstuffs, i.e., freezer and refrigerating compartments for storing foodstuffs in freezing and refrigerating temperatures respectively. The freezer and refrigerating compartments are supplied with cooling air, which are cooled by an evaporator of the refrigerator.

The cooling air is directly supplied by a fan to the interior of the freezer compartment from the evaporator. Some of the cooling air is supplied to the interior of the refrigerating compartment, and some to the interior of the refrigerating compartment. The temperature of the cooling air is a little raised so that it is a refrigerating air, as it flows through a duct internally formed to the refrigerator and is supplied to the refrigerating compartment. The freezer and refrigerating compartments are respectively installed with doors at their front sides to allow foodstuffs to be put in and taken out.

In addition, an amount of drinking water is stored in the interior of the refrigerating compartment. The water is filled up in a reservoir provided in the refrigerating compartment. In order for a user to drink the water stored within the refrigerating compartment, the door should be opened to take out the container filled with the drinking water. However, the refrigerating efficiency of the refrigerator is lowered by frequently opening the door of the refrigerating compartment.

Recently, in order to overcome the above-mentioned efficiency problem, water dispensers have been suggested in which drinking water can be taken out from refrigerating compartments even without opening the door of the refrigerating compartments. FIG. 1 is a sectional view showing a conventional water dispenser 100 of a refrigerator which is installed to the front side of a refrigerating compartment door 10. As shown in FIG. 1, the valve assembly 110 comprises a valve body 120 having an inlet 122 connected to a reservoir (not shown) installed to the inner side of the compartment door 10 and an outlet 124 penetrating through the lower surface thereof, a valve spool 130 for opening and closing the outlet 124, a valve cap 140 for closing an upper portion of the valve body 120, and a lever 150 for moving the valve spool 130 upward and downward by pivoting motions thereof.

The valve spool 130 comprises a valve rod 134 which is connected to the lever 150 by a hinge 132 so as to move upward and downward by the pivoting motions of the lever 150, a packing member 136 which is attached to the lower end of the rod 134 to close the outlet 124 of the valve body 120 when the lever 150 is released, and a spring 138 which is installed between the lower surface of the valve cap 140 and the packing member 136 to exert a biasing force upon the rod 134. The inlet 122 of the valve body 120 communicates with the inner side of the door 10 and is connected to the reservoir attached to the inner side of the door 10. The water contained in the reservoir is introduced into the interior of the valve body 110 through the inlet 122, and the inlet 122 is always filled with the water.

When a user grips a cup 20 and pushes the lever 150 by the cup 20 in order to drink the water contained in the reservoir, the lever 150 is pivoted to move the rod 134 upward by overcoming the biasing force of the spring 138, thereby opening the outlet 124. Then, the water contained in the reservoir flows through the outlet 124 and fills the cup 20 positioned below the outlet 124.

For sanitary reasons, a disposable cup such as a paper cup or a paper-envelope cup is generally used as a cup for the water dispenser. However, since the paper cup 20 is made of a soft material, it is apt to be deformed when the lever 150 is pushed by means of the paper cup 20. Therefore, the user usually pushes the lever 150 by the hand which grips the paper cup 20. In that case, however, it has a disadvantage that the hand is also apt to be wet by the water dropping from the outlet 124 of the valve assembly 110. Further, the large space occupied by the valve assembly 110 to be connected to the reservoir of the refrigerating compartment impair the space efficiency of the refrigerating compartment. In addition, deposits which adulterate the water contained in the reservoir can be formed in the inner surface of the inlet 122 of the valve body 120 over time.

A water dispenser which is directed to overcome the above-mentioned disadvantages is disclosed in Korean Utility Model Laid Open No. 95-33940. As shown in FIG. 2, the water dispenser 200 comprises a reservoir 210 for storing water, a dispensing panel 220, in which the reservoir 210 is positioned upside down, a dispensing port 230, and a lever 250 for operating the dispensing port 230.

A spout 212 for pouring water therethrough is formed in the reservoir 210 and is engaged with a cap 214. A valve 216 is mounted in the cap 214 such that when the valve 216 is opened, the water contained in the reservoir 210 is exhausted through the spout 212. The spout 212 of the reservoir 210 is inserted into the connecting hole 222 of the dispensing panel 220. The interior of the connecting hole 222 is maintained filled with the water.

Fixed to the lower end of the connecting hole 222 is a fixing plate 232 in which a plurality of first dispensing holes 234 is formed, and positioned below the fixing plate 232 is an moving plate 236 in which a plurality of second dispensing holes 238 are formed. The first dispensing holes 234 communicate with the second dispensing holes 238 by the movement of the moving plate 236, and the water contained in the reservoir 210 is exhausted outside the reservoir 210.

A bias spring 240 is installed at one side of the moving plate 236 and exerts a biasing force on the moving plate 236. The moving plate 236 is moved by the biasing force so that the first and second dispensing holes 234 and 238 are closed and the outflow of the water is stopped. The moving plate 236 is moved by a lever 250 installed at one side thereof. The lever 250 is pivotally mounted to the inner side of the dispensing panel 220 by means of a hinge 252. By the pivotal movement of the lever 250, the moving plate 236 is moved so as to connect the first and second holes 234 and 238, thus overcoming the biasing force of the bias spring 240. Provided at the inner side of the moving plate 236 is a dispensing nozzle 242 which provides a water flowing path in the interior of the reservoir 210.

When the lever 250 is pushed by a cup or by a hand, the lever 250 is pivoted. Then, the moving plate 236 is moved and the biasing force of the bias spring 240 is overcomed. As a result, the first and second holes 234 and 238 communicate with each other so that the water contained in the reservoir 210 drops.

However, in the water dispenser 200, the fixing plate 232 and the moving plate 236 must be sealed when the first and second holes 234 and 238 are closed. In case the fixing plate 232 and the moving plate 236 are not sealed, the water contained in the reservoir 210 leaks between the fixing plate 232 and the moving plate 236. Therefore, a considerable amount of frictional force is generated between the fixing plate 232 and the moving plate 236, and a large force is needed to pivot the lever 250. Further, the dispenser 200 is apt to be filthy due to deposits formed in the connecting holes 222.

SUMMARY OF THE INVENTION

Therefore, it is an object of the present invention to provide a water dispenser of a refrigerator which is easy to use and increases the efficient use of a door, and in which a valve of the dispenser can be easily opened and closed.

To achieve the above object of the present invention, a water dispenser according to the present invention comprises a reservoir installed in a pocket of the inner side of the refrigerator door, for storing water therein;

a holding member for supporting the pocket;

a dispensing panel having a support conduit in which a latching boss is formed on the inner peripheral surface thereof, a subpanel connected to a lower portion of the support conduit, and a guide plate in which a guide recess is formed at a front side thereof, the guide plate being connected to the lower portion of the support conduit and being opposite to the subpanel;

a valve assembly inserted into and mounted to the holding member, the valve assembly having a connecting section connected to the reservoir, a valve cock selectively closing and opening the connecting section at first and second positions respectively, and a bias spring for exerting a first biasing force on the valve cock so that the valve cock is positioned at the first position; and an opening/closing means pivotally mounted into the subpanel, for moving the valve cock so that the valve cock is positioned either at the first position or at the second position.

The connecting section may include a cap screw-coupled to the reservoir; an outlet conduit for exhausting the water contained in the reservoir; and a guide conduit having a mounting groove formed on the outer peripheral surface thereof. The valve cock comprises a first cylinder in which an inner peripheral surface thereof slides on an outer peripheral surface of the outlet conduit; a second cylinder in which an outer peripheral surface thereof slides on an inner peripheral surface of the outlet conduit; a shoulder connecting the first cylinder to the second cylinder; a packing member for opening and closing the outlet conduit; and a valve rod for moving the packing member upward and downward.

According to the present invention, by the holding member, the valve assembly is inserted into and mounted to a mounting member having a first mounting boss formed on the inner peripheral surface thereof and a second mounting boss formed on the outer peripheral surface thereof.

The subpanel includes an upper plate connected to a lower end of the support conduit, and a lower plate engaged with the upper plate. First and second through-holes are formed in the front and rear side of the subpanel.

The opening/closing means is pivotally mounted in the subpanel, and includes a return spring for generating a second biasing force, a lever which can overcome the second biasing force so as to pivot, and a guide frame which moves the valve assembly while the lever is pivoting.

When a user pivots the lever horizontally, the packing member is moved upward by the guide frame. As a result, the outlet conduit of the valve assembly is opened, so the water contained in the reservoir is exhausted outside through the outlet conduit.

The water dispenser of a refrigerator according to the present invention is simple in structure, increases efficient space use of the refrigerating compartment door, is convenient to use, and can be cleanly maintained.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

A preferred embodiment of a valve assembly of a water dispenser for a refrigerator according to the present invention will be described in detail with reference to the accompanying drawings.

Figure 1:
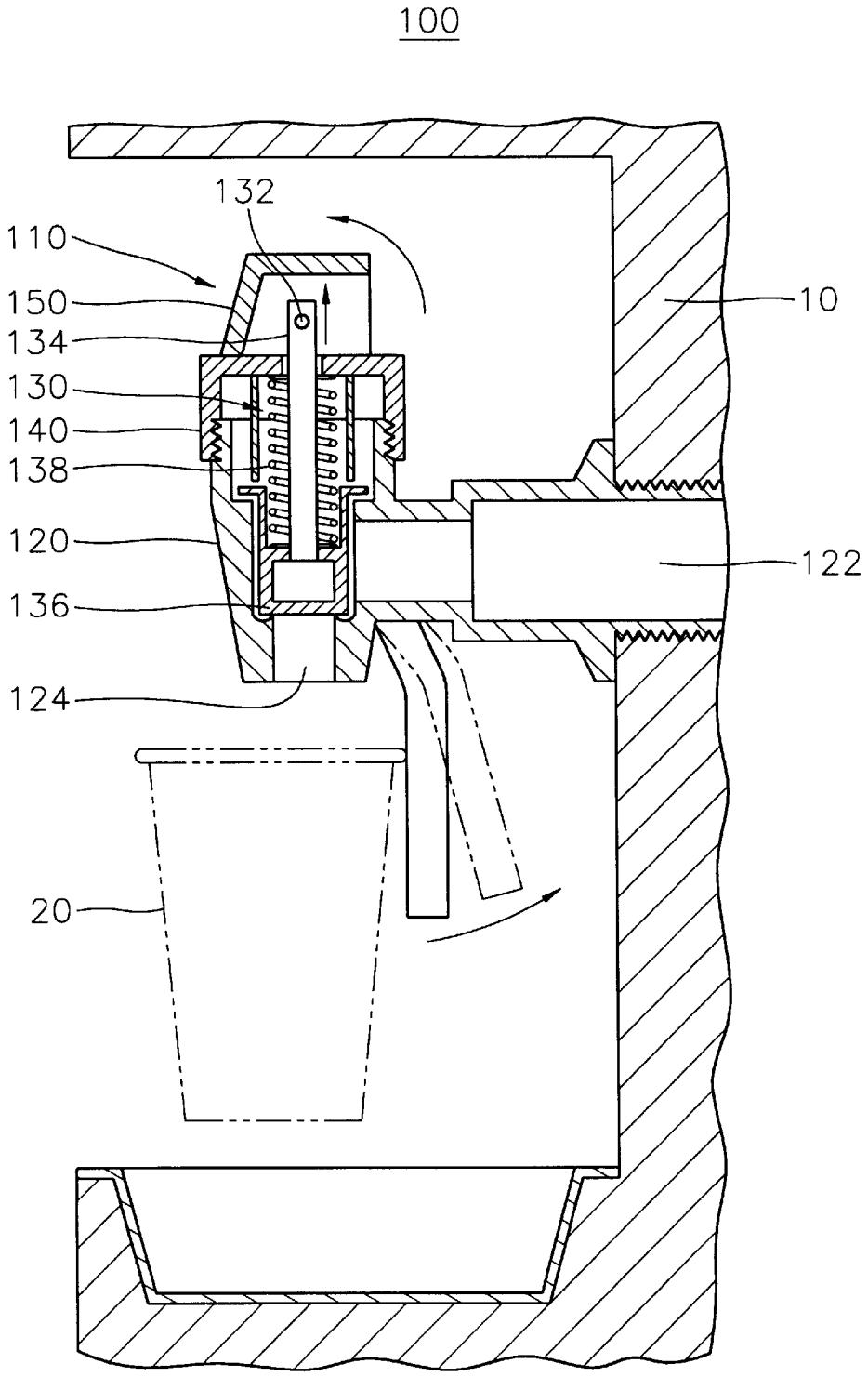
FIG. 1 (PRIOR ART)
FIG. 1 is a sectional view showing a conventional water dispenser of a refrigerator.
Figure 2:
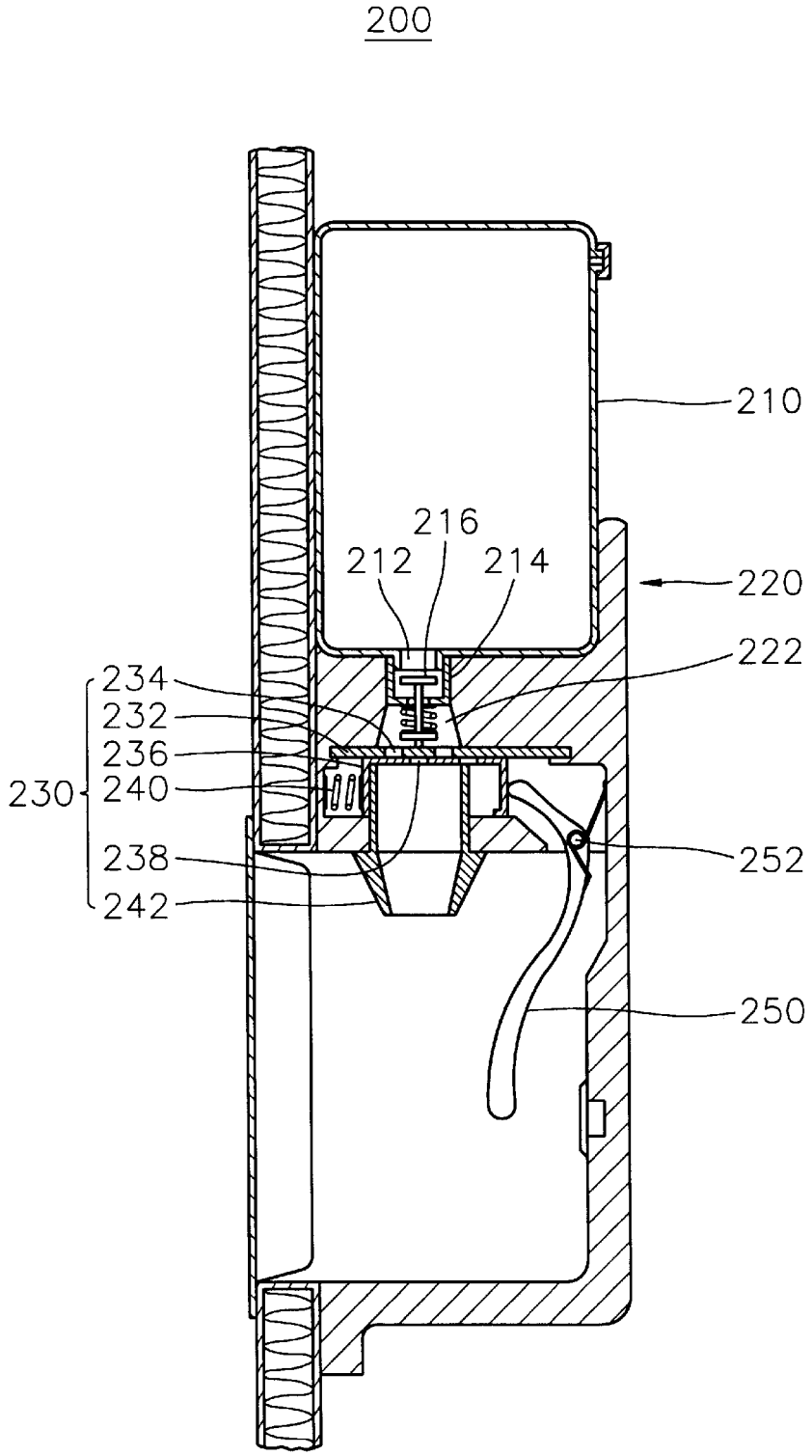
FIG. 2 (PRIOR ART)
FIG. 2 is a sectional view showing another conventional water dispenser of a refrigerator.
Figure 3:
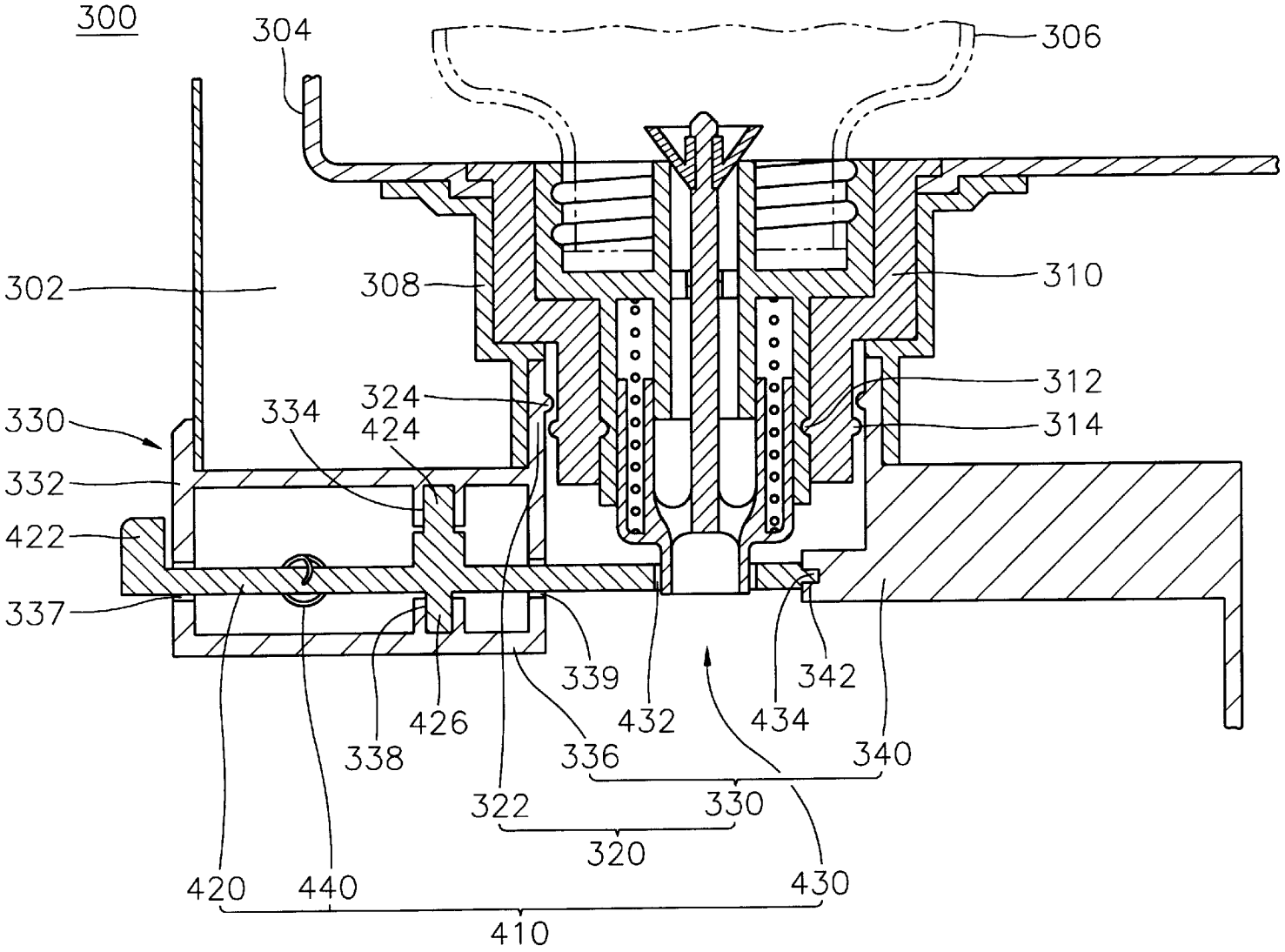
FIG. 3 is a sectional view showing a water dispenser of a refrigerator according to one embodiment of the present invention.
Figure 4:
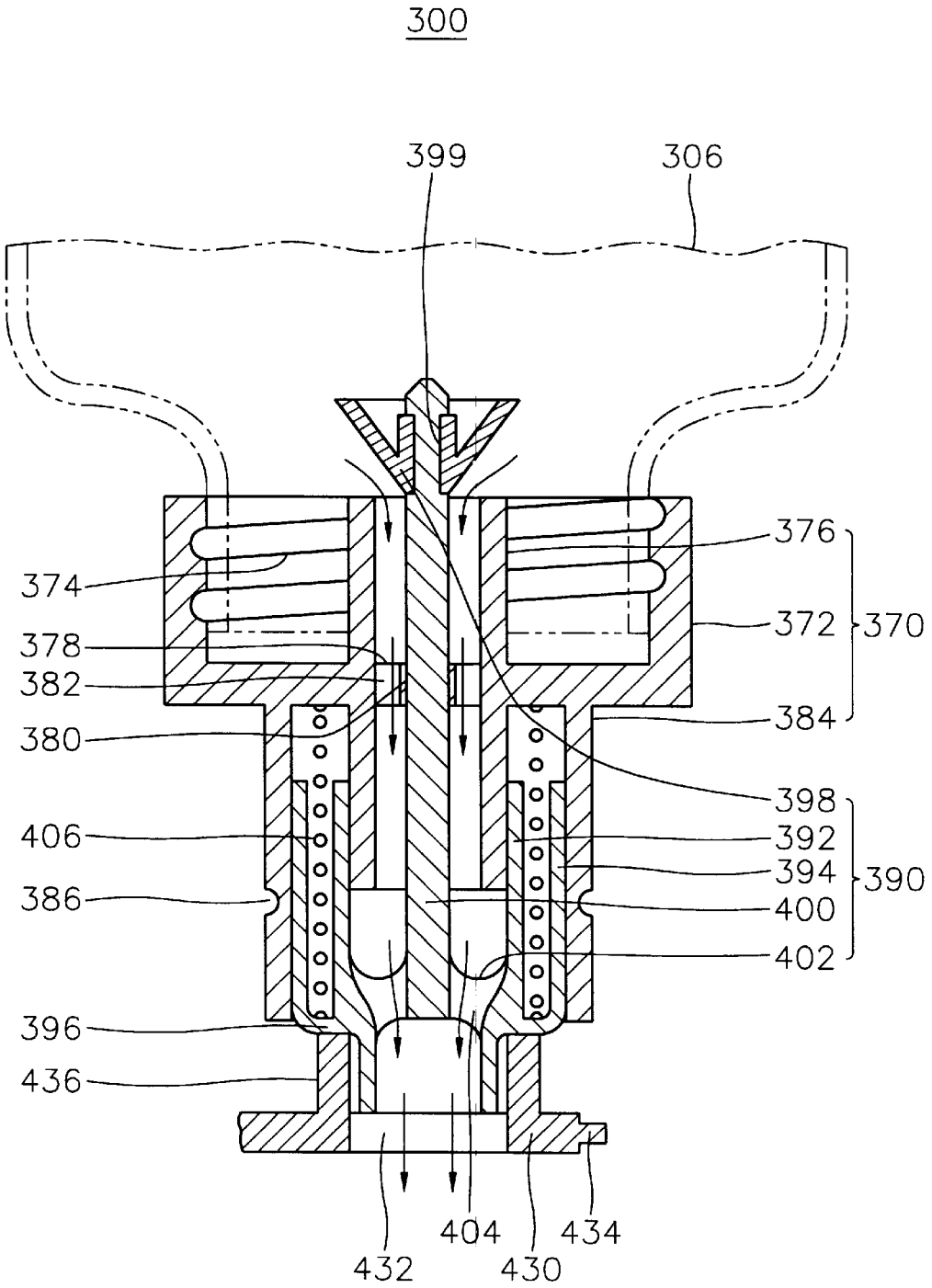
FIG. 4 is a sectional view showing a valve assembly of the water dispenser shown in FIG. 3.

FIG. 3 shows a water dispenser 300 of a refrigerator according to a preferred embodiment of the present invention. As shown in FIG. 3, the water dispenser 300 comprises a reservoir 306 for storing water, and which is located in a pocket 304 inside a refrigerator door 302, a holding member 308 which supports the pocket 304, a dispensing panel 320 which supports the holding member 308, a valve assembly 360 which is engaged with the reservoir 306 and which opens/closes the reservoir 306, and an opening/closing section 410 which operates the valve assembly 360. The reservoir 306 stores water and is inserted into and mounted to the holding member 308 upside down, after the valve assembly 360 is assembled.

The holding member 308, as shown in FIG. 3, has a bell-shaped cross section and has upper and lower inner surface. A mounting member 310 is inserted into the holding member 308. The mounting member 310 has also a bell-shaped cross section, and first and second mounting bosses 312 and 314 are respectively formed on the inner and outer peripheral surfaces thereof. The valve assembly 360 is inserted into the mounting member 310.

Figure 5:
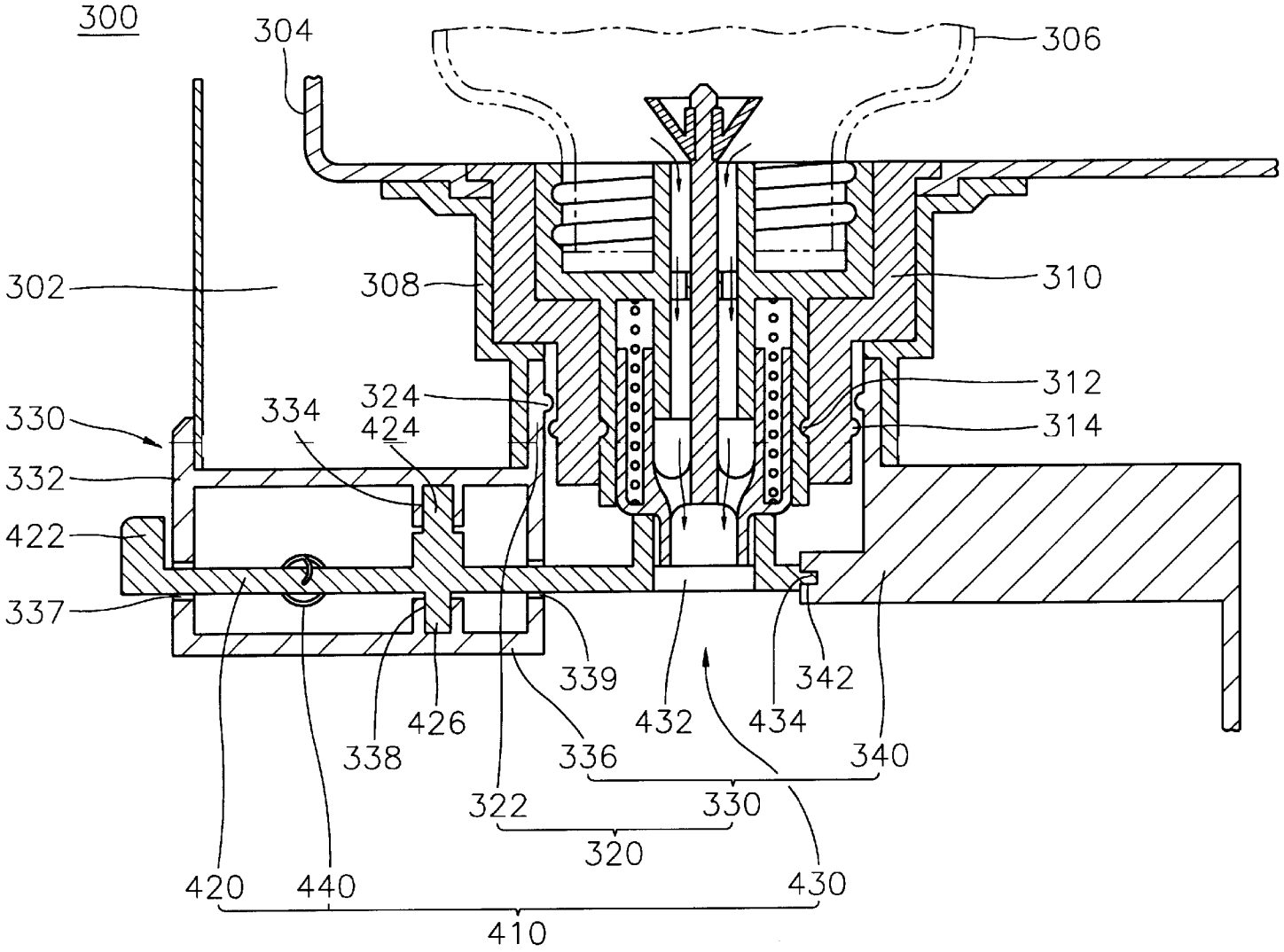
FIG. 5 is a sectional view showing an open state of the water dispenser shown in FIG. 3.
Figure 6:
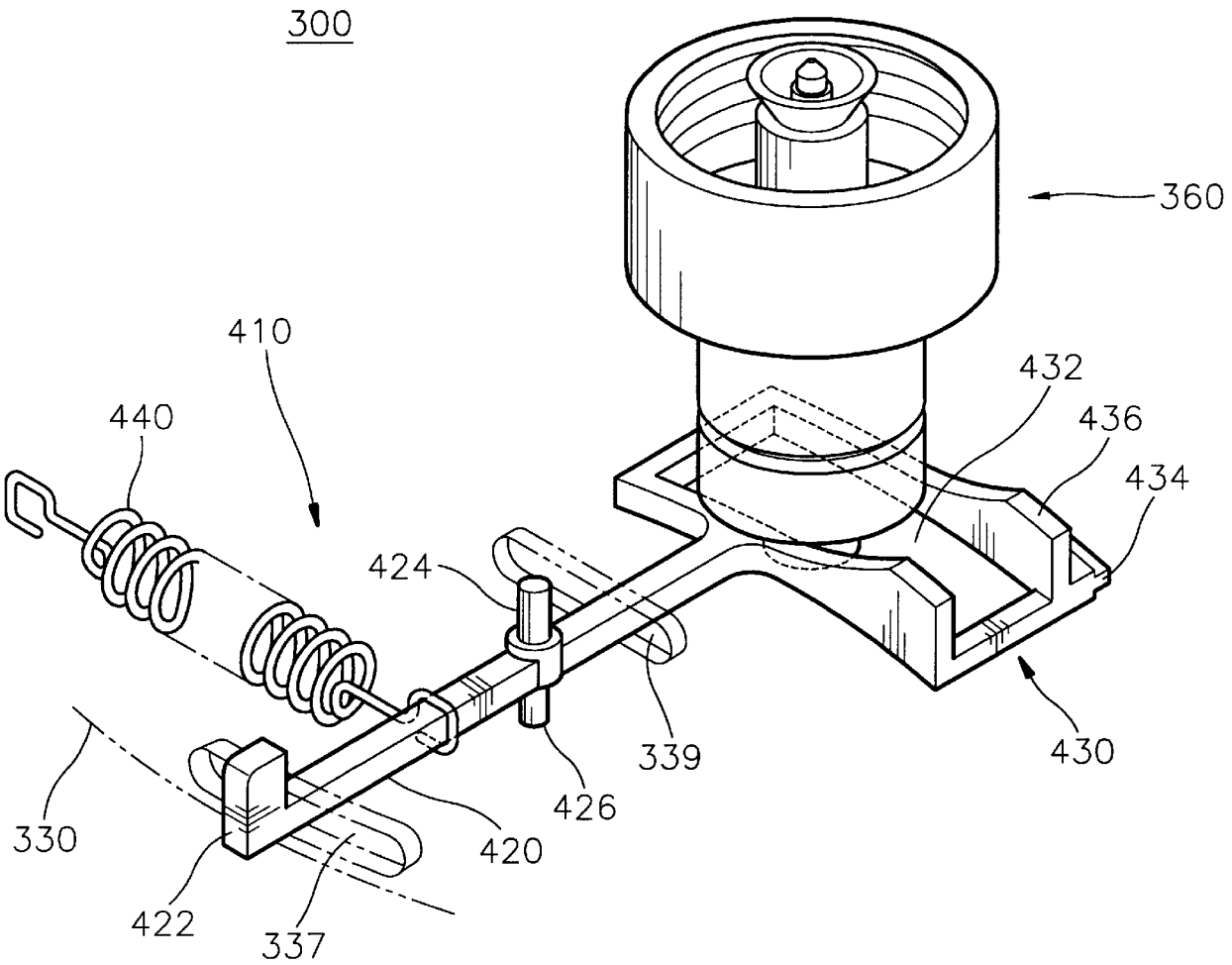
FIG. 6 is a perspective view for illustrating an operation of the valve assembly shown in FIG. 3.

As shown in FIG. 5, the valve assembly 360 comprises a connecting section 370 which is connected to the reservoir 306, a valve cock 390 which closes and opens the connecting section 370 at first and second positions respectively, and a bias spring 406 which exerts a first biasing force on the valve cock 390 so that the valve cock 390 is positioned at the first position.

The connecting section 370 includes a cap 372 screw-coupled to the reservoir 306, an outlet conduit 376 which penetrates the center of the cap 372 and is formed along the length of the cap 372, and through which the water contained in the reservoir 306 flows, a guide conduit 384 which is formed on the bottom surface of the cap 372 along the length of the cap 372, the guide conduit 384 being concentric to an outlet conduit 376 and having a diameter larger than that of the outlet conduit 376, and a guide conduit 384 having a mounting groove 386 which is formed on the outer peripheral surface thereof, and into which the first mounting boss 312 of the mounting member 310 is inserted.

The inner peripheral surface of the cap 372 is threaded so as to be engaged with the reservoir 306. At the inner side of the outlet conduit 376 is formed a guide member 378. A guide hole 380 is formed at the center of the guide member 378, and a plurality of first exhausting holes 382 are formed adjacent to the guide hole 380. The water from the reservoir 306 flows to the lower portion of the outlet conduit 376 through the first exhausting hole 382. Integrally formed are the cap 372, the outlet conduit 376, the guide conduit 384, and the guide member 378.

The valve cock 390 comprises a first cylinder 392 in which the inner surface thereof slides on the outer surface of the outlet conduit 376, a second cylinder 394 in which the outer surface thereof slides on the inner surface of the guide conduit 384, a shoulder 396 which connects the first cylinder 392 to the second cylinder 394, a packing member 398 which closes the outlet conduit 376 at the first position and opens the outlet conduit 376 at the second position, a valve rod 400 in which the packing member 398 is inserted into and fixed to the upper end thereof, and which is inserted into the guide hole 380 and moves the packing member 398 from the first position to the second position, and a fixing rib 402 which is formed in the interior of the first cylinder 392 so as to fix the valve rod 400, and in which a second exhausting hole 404 is formed.

The packing member 398 has a conical shape and is made of silicon, a rubber or the like. An engaging hole 399 is formed at the center of the packing member 398. The valve rod 400 is engaged with the packing member 398 by inserting the upper end thereof into the engaging hole 399 of the packing member 398. The packing member 398 is moved by the valve rod 400 to the first or second position, and closes or opens the outlet conduit 376.

Integrally formed are the first cylinder 392, the second cylinder 394, the valve rod 400, the shoulder 396, and the fixing rib 402. The bias spring 406 is installed in a space formed by the cap 372, the outlet conduit 376, the guide conduit 384, and the first and second cylinders 392 and 394. The biasing force of the bias spring 406 forces the valve cock 390 to move to the first position.

The holding member 308 is supported by the dispensing panel 320. The dispensing panel 320 comprises a support conduit 322 which is inserted into the inner peripheral surface of the holding member 308 and supports the holding member 308. On the inner surface of the support conduit 322 is formed a latching boss 324 which cooperates with a second mounting boss 314 of the mounting member 310.

When the mounting member 310 is inserted into the interior of the holding member 308, the second mounting boss 314 makes contact with the latching boss 324. The support conduit 322 and the mounting member 310 are then deformed in the radial direction by the latching boss 324 and the second mounting boss 314. Once the second mounting boss 314 passes over the latching boss 324, the mounting member 310 does not deviate from the support conduit 322 since the latching boss 324 blocks the second mounting boss 314.

After the mounting member 310 is inserted into the holding member 308, the valve assembly 360 is inserted into the mounting member 310. The valve assembly 360 is inserted into and fixed to the mounting member 310 in the same manner that the first mounting boss 312 is inserted into the mounting groove 386 of the guide conduit 384.

The support conduit 322 is supported by a subpanel 330 and a guide plate 340. The subpanel 330 includes an upper plate 332 connected to the support conduit 322 and a lower plate 336 engaged with the upper plate 332. A first hinge recess 334 is formed on the bottom surface of the upper plate 332, and a second hinge recess 338 is formed on the upper surface of the lower plate 336. The first and second plates 332 and 336 are engaged with each other so as to form first and second through-holes 337 and 339 on the front and rear surfaces of the engaged body respectively.

The guide plate 340 is connected to the support conduit 322, and a guide recess 342 is formed on the front side of the guide plate 340. The guide plate 340, the subpanel 330, and the support conduit 322 are integrally formed, and the guide plate 340 and the subpanel 330 face each other.

An opening/closing section 410 for opening/closing the valve assembly 360 is mounted in the subpanel 330. Opening/closing section 410 comprises a return spring 440 which is mounted in the interior of the subpanel 330 and generates a second biasing force, a lever 420 which overcomes the second biasing force of the return spring 440 so as to pivot, and a guide frame 430 which moves the valve cock 390 to the second position while the lever 420 is pivoting.

First and second hinges 424 and 426 are respectively formed in the upper and lower surfaces of the lever 420. The first and second hinges 424 and 426 are respectively inserted into the first and second hinge recesses 334 and 338. The return spring 440 is connected to the lever 420 and exerts the second biasing force on the lever 420. One side of the lever 420 is inserted into the first through-hole 337, and the other end of the lever 420 is inserted into the second through-hole 339. The first and second through-holes 337 and 339 confine the pivot angle of the lever 420 when the lever 420 is overcoming the second biasing force of the return spring 440 so as to pivot, and when the lever 420 is returning to the original position by the second biasing force.

The guide frame 430 is connected to one side of the lever 420. At the center portion of the guide frame 430 is formed a dispensing hole 432 through which the water exhausted through the valve assembly 360 flows. On the upper surface of the guide frame 430 are formed a pair of cams 436 which move the shoulder 396 of the valve cock 390 to the second position. On one side of the guide frame 430 is formed a guide boss 434 which is slidably inserted into the guide recess 342 and guides the guide frame 430. When the guide frame 430 is pivoted by the lever 420, the guide boss 434 is guided by the guide recess 342 and is pivoted horizontally. As a result, the water contained in the reservoir 306 drops as the valve cock 390 is elevated by the horizontal and pivotal movement of the lever 420 and the guide frame 430, thereby opening the reservoir 306.

A knob 422 is formed at one side of the lever 420 so as to pivot the lever 420. A user can be supplied with the water contained in the reservoir 306 by pivoting the lever 420 with a hand. Integrally formed are the knob 422, the lever 420, and the guide frame 430. A cup is positioned below the opening/closing section 410 to receive the water contained in the reservoir 306.

Hereinafter, the operation of the water dispenser 300 of a refrigerator according to an embodiment of the present invention will be explained.

Firstly, the valve assembly is engaged with the reservoir 306 filled with water, and then the mounting member 310 is inserted into the holding member 308. The valve assembly 360 is inserted into the mounting member 310, while the reservoir 306 is upside down.

When a user pivots the lever 420 with a hand, the cams 436 of the guide frame 430 make contact with the shoulder 396 of the valve cock 390. Then, the shoulder 396 overcomes the biasing force of the bias spring 406 and moves upward from the first position to the second position, and the packing member opens the outlet conduit 376. While the outlet conduit 376 is open, the water contained in the interior of the reservoir 306 drops into the cup positioned below the opening/closing section 410 through the first and second exhausting holes 382 and 404 and the dispensing hole 432.

If the knob 422 is released, the lever 420 is pivoted to its original position by the second biasing force of the return spring 440, and valve rod 400 at the second position is moved downward to the first position by the cams 436. As a result, the packing member 398 closes the outlet conduit 376 to prevent the exhaustion of the water contained in the reservoir 306.

The water dispenser according to the present is simple in structure, increases efficient space use of the refrigerating compartment door and is convenient to use, and can be clearly maintained.

While the present invention has been particularly shown and described with reference to particular embodiment thereof, it will be understood by those skilled in the art that various changes in form and detail may be effected therein without departing from the spirit and scope of the invention as defined by the appended claims.

What is claimed is:

1. A water dispenser of a refrigerator comprising:

a reservoir installed in a pocket formed at an inner side of a refrigerator door, for storing water therein;

a holding member for supporting the pocket;

a dispensing panel having a support conduit formed at an inner surface thereof with a latching boss for stably receiving the reservoir, a subpanel connected to a lower portion of the support conduit, and a guide plate formed at a front side thereof with a guide recess, the guide plate being connected to the lower portion of the support conduit and being opposite to the subpanel;

a valve assembly inserted into and mounted to the holding member, the valve assembly having a connecting section connected to the reservoir, a valve cock for selectively closing and opening the connecting section at first and second positions respectively, and a bias spring for exerting a first biasing force on the valve cock so that the valve cock is positioned at the first position; and an opening/closing means pivotally mounted into the guide recess of the guide plate, for moving the valve cock so that the valve cock is positioned either at the first position or at the second position.

2. A water dispenser of a refrigerator according to claim 1, wherein the connecting section comprises:

a cap screw-coupled to the reservoir;

an outlet conduit formed along the length of the cap and penetrating the centerline of the cap, for exhausting the water contained in the reservoir;

a guide member formed at an inner side of the outlet conduit, the guide member having a first guide hole formed at a center portion thereof and a plurality of first exhausting hole formed adjacent to the first guide hole; and a guide conduit formed on the bottom surface of the cap along the length of the cap, the guide conduit being concentric to the outlet conduit, having a diameter larger than that of the outlet conduit, and having a mounting groove formed on an outer peripheral surface thereof.

3. A water dispenser of a refrigerator according to claim 2, wherein the cap, the outlet conduit, the guide member, and the guide conduit are integrally formed.

4. A water dispenser of a refrigerator according to claim 2, further comprising:

a mounting member having a bell-shaped cross section, the mounting member having a first mounting boss which is formed on an inner peripheral surface thereof and is inserted into the mounting groove of the guide conduit, and having a second mounting boss which is formed on an outer peripheral surface thereof and is in cooperation with the latching boss of the support conduit.

5. A water dispenser of a refrigerator according to claim 2, wherein the valve cock further comprises:

a first cylinder in which an inner peripheral surface thereof slides into an outer peripheral surface of the outlet conduit;

a second cylinder in which an outer peripheral surface thereof slides over an inner peripheral surface of the outlet conduit;

a shoulder connecting one end of the first cylinder to one end of the second cylinder;

a packing member for closing the outlet conduit at the first position and opening the outlet conduit at the second position;

a valve rod slidably inserted into the guide hole, for moving the packing member to the first or second position, the packing member being inserted into and fixed to an upper end thereof; and a fixing rib formed in the interior of the first cylinder and fixed to a lower end of the valve rod, and in which a plurality of second exhausting holes are formed.

6. A water dispenser of a refrigerator according to claim 5, wherein the packing member has a conical shape and is comprised of silicon.

7. A water dispenser of a refrigerator according to claim 5, wherein the packing has a conical shape and is comprised of a rubber.

8. A water dispenser of a refrigerator according to claim 5, wherein the first and second cylinders, the shoulder, and the valve rod are integrally formed.

9. A water dispenser of a refrigerator according to claim 5, wherein the bias spring is installed in a space formed by the outlet conduit, the guide conduit, the first cylinder, and the second cylinder.

10. A water dispenser of a refrigerator according to claim 5, wherein the subpanel comprises:

an upper plate connected to a lower end of the support conduit, in which a first hinge recess is formed on the bottom surface thereof; and a lower plate engaging with the upper surface, in which a second hinge recess is formed on the upper surface thereof, the subpanel having a first through-hole on the front surface thereof and a second through-hole on the rear surface thereof formed by engaging the upper and lower plates so that an angle of the opening/closing means is confined by the first and second through-holes.

11. A water dispenser of a refrigerator according to claim 10, wherein the opening/closing means comprises:

a return spring mounted to the subpanel, for generating a second biasing force;

a lever for overcoming the second biasing force of the return spring so as to pivot while guided by the guide recess, in which a first hinge is formed on an upper surface thereof and a second hinge is formed on the bottom surface thereof, the first and second hinges being inserted into the first and second hinge recesses, respectively;

a guide frame connected to one side of the lever, in which a pair of cams for moving the shoulder to the second position while the lever is overcoming the second biasing force to pivot are formed on an upper surface thereof, and in which a dispensing hole for exhausting the water contained in the reservoir is formed between the cams; and a knob connected to one side of the lever, in which a pivot angle is confined by the first and second through-holes, and in which the lever, the guide frame, and the knob are integrally formed.

12. A water dispenser of a refrigerator comprising:

a reservoir installed in a pocket formed at an inner side of a refrigerator door, for storing water therein;

a holding member for supporting the pocket, the holding member having a bell-shaped cross section;

a dispensing panel having a support conduit being formed at an inner wall thereof with a latching boss for stably receiving the reservoir, a subpanel connected to a lower portion of the support conduit, and a guide plate being formed at a front side thereof with a guide recess, the guide plate being connected to the lower portion of the support conduit and being opposite to the subpanel;

a valve assembly inserted into and mounted to the holding member, the valve assembly having a connecting section connected to the reservoir, a valve cock selectively closing and opening the connecting section at first and second positions respectively, and a bias spring for exerting a first biasing force on the valve cock so that the valve cock is positioned at the first position; and an opening/closing means pivotally mounted into the guide recess of the guide plate, for moving the valve cock so that the valve cock is positioned either at the first position or at the second position.

13. A water dispenser of a refrigerator according to claim 12, wherein the connecting section comprises:

a cap screw-coupled to the reservoir; an outlet conduit formed along the length of the cap and penetrating the centerline of the cap, for exhausting the water contained in the reservoir;

a guide member formed at an inner side of the outlet conduit, the guide member having a first guide hole formed at a center portion thereof, and having a plurality of first exhausting hole formed adjacent to the first guide hole; and a guide conduit formed on the bottom surface of the cap along the length of the cap, the guide conduit being concentric to the outlet conduit, having a diameter larger than that of the outlet conduit, and having a mounting groove formed on the outer peripheral surface thereof, and the cap, the guide member, and the guide conduit being integrally formed.

14. A water dispenser of a refrigerator according to claim 13, further comprising:

a mounting member having a bell-shaped cross section, the mounting member having a first mounting boss formed on an inner peripheral surface thereof and inserted into the mounting recess of the guide conduit, and having a second mounting boss which is formed on an outer peripheral surface thereof and cooperates with the latching boss of the support conduit.

15. A water dispenser of a refrigerator according to claim 13, wherein the valve cock further comprises:

a first cylinder in which an inner peripheral surface thereof slides on an outer peripheral surface of the outlet conduit;

a second cylinder in which an outer peripheral surface thereof slides on an inner peripheral surface of the outlet conduit;

a shoulder connecting one end of the first cylinder to one end of the second cylinder;

a packing member for closing the outlet conduit at the first position and opening the outlet conduit at the second position, the packing member having a conical shape and being comprised of a rubber;

a valve rod slidably inserted into the guide hole, for moving the packing member to the first or second position, the packing member being inserted into and fixed to an upper end thereof; and a fixing rib formed in the interior of the first cylinder and fixed to a lower end of the valve rod, a plurality of second exhausting holes being formed in the fixing rib, the first and second cylinders, the shoulder, and the valve rod being integrally formed in the fixing rib, and the bias spring being installed in a space formed by the outlet conduit, the guide conduit, the first cylinder, and the second cylinder.

16. A water dispenser of a refrigerator according to claim 15, wherein the subpanel comprises:

an upper plate connected to a lower end of the support conduit, in which a first hinge recess is formed on the bottom surface thereof; and a lower plate engaging with the upper surface, in which a second hinge recess is formed on the upper surface thereof, the subpanel having a first through-hole on the front surface thereof and a second through-hole on the rear surface thereof formed by engaging the upper and lower plates so that an angle of the opening/closing means is confined by the first and second through-holes.

17. A water dispenser of a refrigerator according to claim 16, wherein the opening/closing means comprises:

a return spring mounted to the subpanel, for generating a second biasing force;

a lever for overcoming the second biasing force of the return spring so as to pivot while guided by the guide recess, in which a first hinge is formed on an upper surface thereof and a second hinge is formed on the bottom surface thereof, the first and second hinges being inserted into the first and second hinge recesses respectively;

a guide frame connected to one side of the lever, in which a pair of cams for moving the shoulder to the second position while the lever is overcoming the second biasing force to pivot are formed on an upper surface thereof, and in which a dispensing hole for exhausting the water contained in the reservoir is formed between the cams; and a knob connected to one side of the lever, in which a pivot angle is confined by the first and second through-holes, and in which the lever, the guide frame, and the knob are integrally formed.

18. A water dispenser of a refrigerator comprising:

a reservoir installed in a pocket formed at an inner side of a refrigerator door for storing water therein;

a holding member for supporting the pocket, the holding member having a bell-shaped cross section;

a dispensing panel having a support conduit being formed at an inside wall thereof with a latching boss, an upper plate connected to a lower end of the support conduit being formed at an underside thereof with a first hinge recess, and a lower plate engaging with the upper surface and being formed at an upper surface thereof with a second hinge recess, and a guide plate being formed at a front side thereof with a guide recess, the upper plate being at a front side thereof with a first through-hole and at a rear side thereof with a second through-hole, the guide plate being connected to a lower portion of the support conduit and being opposite to the subpanel;

a valve assembly for opening/closing the reservoir, the valve assembly having a cap screw-coupled to the reservoir, an outlet conduit formed along the length of the cap and penetrating a center portion of the cap, for exhausting the water contained in the reservoir, a guide member which is formed at an inner side of the outlet conduit, is formed at a center portion thereof with a first guide hole and is formed with a plurality of first exhausting holes adjacent to the first guide hole, a guide conduit which is formed on the bottom surface of the cap along the length of the cap, is concentric with the outlet conduit, has a diameter larger than that of the outlet conduit and is formed at an outer surface thereof with a mounting groove, a first cylinder an inner surface of which slides along an outer surface of the outlet conduit, a second cylinder an outer surface of which slides along an inner surface of the outlet conduit, a shoulder connecting one end of the first cylinder to one end of the second cylinder, a packing member which closes the outlet conduit at a first position, opens the outlet conduit at a second position, has a conical shape and is made of rubber, a valve rod which is slidably inserted into the guide hole for moving the packing member to the first or second position and is inserted at an upper end thereof into the packing member, and a fixing rib which is formed in the interior of the first cylinder, is fixed to a lower end of the valve rod, and is formed with a plurality of second exhausting holes;

a mounting member for mounting the valve assembly to the holding member, the mounting member having a bell-shaped cross section, having a first mounting boss which is formed on an inner peripheral surface thereof, is inserted into the mounting groove of the guide conduit, and having a second mounting boss which is formed on an outer peripheral surface thereof cooperates with the latching boss of the support conduit; and an opening/closing section for opening/closing the valve assembly, the opening/closing section having a return spring mounted to the subpanel for generating a second biasing force, a lever for overcoming the second biasing force of the return spring so as to pivot while guided by the guide recess which is formed at upper and lower surfaces thereof with first and second hinges respectively which are inserted into the first and second hinge recesses, a guide frame which is connected to a first side of the lever, is formed at an upper surface thereof with a couple of cams for moving the shoulder to the second position when the lever pivots and is formed at a portion thereof between the cams with a dispensing hole for exhausting the water contained in the reservoir, and a knob connected to a second side of the lever.

* * * * *